US006293083B1

(12) United States Patent
Schneider

(10) Patent No.: US 6,293,083 B1
(45) Date of Patent: Sep. 25, 2001

(54) SPINNING ROTOR FOR AN OPEN-END SPINNING FRAME

(75) Inventor: Harald Schneider, Geilenkirchen (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/676,826

(22) Filed: Oct. 2, 2000

(30) Foreign Application Priority Data

Oct. 2, 1999 (DE) ..... 199 47 547

(51) Int. Cl.[7] ..... D01H 4/00
(52) U.S. Cl. ..... 57/414; 57/404; 57/416
(58) Field of Search ..... 57/414, 416, 404

(56) References Cited

U.S. PATENT DOCUMENTS

| | | | | |
|---|---|---|---|---|
| 1,811,574 | * | 6/1931 | Barrett | 47/72 X |
| 1,868,853 | * | 7/1932 | Sievers | 47/72 |
| 2,845,735 | * | 8/1958 | Werner | 47/72 |
| 3,096,182 | * | 7/1963 | Berzins | 106/1 |
| 4,193,253 | * | 3/1980 | Herbert et al. | 57/404 |
| 4,397,144 | * | 8/1983 | Raasch et al. | 57/404 |
| 4,928,477 | * | 5/1990 | Kalitzki et al. | 57/416 |
| 4,946,290 | * | 8/1990 | Matyja | 206/423 X |
| 5,865,011 | * | 2/1999 | Weder | 53/397 |
| 6,006,512 | * | 12/1999 | Schmid | 57/414 |
| 6,062,015 | * | 5/2000 | Schürmann et al. | 57/414 |
| 6,108,973 | * | 8/2000 | Weder | 47/72 |
| 6,173,552 | * | 1/2001 | Weder | 53/397 |

FOREIGN PATENT DOCUMENTS

| | | | | |
|---|---|---|---|---|
| 4305626 | * | 2/1993 | (DE) | 57/404 |
| 3810775C2 | * | 5/1995 | (DE) . | |
| 19737332 | * | 8/1997 | (DE) | 57/404 |
| 19743597 | * | 10/1997 | (DE) | 57/404 |
| 3810775 | * | 3/1998 | (DE) | 57/404 |
| 19713359A1 | * | 10/1998 | (DE) . | |
| 19822265A1 | * | 12/1998 | (DE) . | |
| 19825906A1 | * | 2/1999 | (DE) . | |

* cited by examiner

*Primary Examiner*—Danny Worrell
(74) *Attorney, Agent, or Firm*—Kennedy Covington Lobdell & Hickman, LLP

(57) ABSTRACT

A spinning rotor for an open-end spinning frame has a coating of a non-ferrous metal with hard material granules embedded therein, which is applied to the surface of the base material (12), in particular a nickel layer with diamond granules, wherein the coating is comprised of at least two layers (7, 10) containing hard material granules, and an intermediate layer (9) free of hard material granules between the layers (7, 10) containing hard material granules. In case of a separation in places of the wear protection layer, such as can be caused by a scraper in the course of cleaning the spinning rotor, wear protection and spinning properties at the damaged places of the spinning rotor are preserved. As a result, it is possible to prevent a considerable shortening of the service life of the spinning rotor.

7 Claims, 1 Drawing Sheet

SPINNING ROTOR FOR AN OPEN-END SPINNING FRAME

CROSS-REFERENCES TO RELATED APPLICATIONS

This application claims the benefit of German patent application 19947547.4 filed Oct. 2, 1999, herein incorporated by reference.

FIELD OF THE INVENTION

The present invention relates to a spinning rotor for an open-end spinning frame and, more particularly, to such a spinning rotor wherein at least those surfaces which come into contact with the textile fibers being spun or the resultant spun yarn have an applied coating of a non-ferrous metal with hard material granules embedded therein.

BACKGROUND OF THE INVENTION

Spinning rotors are subject to extensive wear of the surfaces which come into contact with the textile fibers being spun or the resultant spun yarn. It is known to apply a coating having hard material granules embedded therein to the surface of the spinning rotor to increase the wear resistance of the rotor surface. A representative form of such a coating is a nickel-diamond coating, for example. It is intended to also achieve a good spinning performance of the spinning rotor by means of the nickel-diamond coating, besides good wear properties.

Coatings with embedded hard material granules are known in a variety of embodiments. German Patent Publication DE 197 13 359 A1, for example, describes a spinning rotor with a rotor cup, whose inner surface has a nickel dispersion layer of uniform layer thickness, wherein the concentration of the hard material granules embedded in the nickel dispersion layer is clearly less on the fiber slide face in the area of the surface of the nickel dispersion layer than in the rotor groove.

With the spinning rotor for open-end spinning units represented in German Patent Publication DE 198 25 906 A1, the fiber collection groove is provided with a nickel-diamond coating, and the fiber slide face with a coating of pure nickel. The coatings are applied in separate coating operations and separate baths. In the course of this coating operation, the entire inner and outer contours of the rotor disk are initially provided with a nickel coating, although from the viewpoint of function it is only required on the fiber slide face. In this manner, the nickel coating provides corrosion protection of the remaining surfaces. The nickel-diamond coating is thereafter applied to the nickel coating only in the fiber collection groove.

German Patent Publication DE 198 22 265 A1discloses an open-end spinning rotor with a fiber slide face provided with a nickel-diamond coating. This nickel-diamond coating consists of an inner support layer and an outer working layer. In this case, the diamond granules embedded in the inner support layer are larger than the diamond granules embedded in the outer working layer. The support layer and the working layer are interlocked.

In addition to the wear caused by the fiber material, the surface at the interior of the spinning rotor can be subjected to mechanical, intermittently occurring stress during the cleaning process. Cleaning of the rotor interior is performed in case of a malfunction report triggered by soiling of the spinning rotor, or as a part of the piecing process. Various processes for cleaning rotors are known. The rotor surface is stressed to a greater or lesser degree, depending on the intensity of cleaning. Since normally the complete cleaning of the spinning rotor is desired, intensive cleaning processes are preferred. In many cases, blowing compressed air through the spinning rotor is not sufficient by itself, since shell particles can become jammed in the narrow rotor grooves. Dependable cleaning is assured if the spinning box is flipped open and the spinning rotor is worked by means of suitable instruments. In the course of a customary intensive cleaning process to remove or avoid the interference with the spinning quality or with piecing, the dirt on the inside of the spinning rotor, in particular in the rotor groove, is loosened by means of a scraper and removed from the rotor by compressed air. The scraper customarily also consists of a wear- resistant material, for example fiberglass-reinforced plastic or hardened material, such as steel. Pieces can be broken out of the above-described rotor coating because of the stress which is exerted by the scraper on the coated surface. Breaking or flaking off of the coating occurs in an uncontrolled manner. The separated pieces can be large enough so that the base material of the spinning rotor is exposed. As a result, the wear protection by means of the nickel-diamond coating is completely interrupted in places. These places can promote the breaking off of further adjoining pieces of the known coating down to the base material.

Flaking or breaking off of pieces of the coating can also be triggered by the oscillations occurring at the rotor.

Pieces of the coating used for wear protection down to the base material can flake off from all known nickel-diamond coatings. The service life of the spinning rotor is clearly reduced by this damage.

OBJECT AND SUMMARY OF THE INVENTION

It is accordingly an object of the present invention to maintain protection against wear of the rotor surface, even when pieces of the coating thereon have flaked off or been broken or otherwise removed or damaged, by means of a coating with hard material granules embedded therein on the damaged area of the surface.

This object is attained in accordance with the present invention by providing a spinning rotor with a coating of at least two layers containing hard material granules, between which there is an intermediate layer which is essentially free of hard material granules. With such an embodiment of protective coating, it is possible to prevent the wear protection achieved by means of the coating containing hard material granules from being completely removed in places because of the removal of a piece of the coating.

It has been shown that, with the embodiment of a protective coating in accordance with the present invention, only portions of the uppermost layer containing hard material granules are separated when pieces of the coating are broken or flake off, and the layer containing hard material granules following under the respective intermediate layer is preserved and maintains the wear protection.

To assure sufficient wear protection, the layers containing hard material granules are advantageously at least about 10 $\mu$m thick. The layers free of hard material granules are preferably between about 2 $\mu$m and about 10 $\mu$m thick. Such a layer thickness of the intermediate layer has been shown to be particularly advantageous in the event any flaking off of the coating occurs. While such flaking or other separation of the coating is still undesirable with coatings in accordance with the present invention, the flaking-off process is better controlled in that the breaking or flaking off of a piece of the coating is essentially limited to the uppermost layer containing hard material granules.

The non-ferrous material is hardenable, preferably for example nickel, and the hard material granules preferably are diamond granules, which embodiments result in good wear properties, in particular of the layers with hard material granules embedded therein. Advantageously, the coating of the non-ferrous material and the hard material granules is precipitated in a single nickel dispersion bath, in which the concentration of the hard material granules distributed therein can be preprogrammed. The manufacture of spinning rotors in accordance with the invention can thereby take place without interruption and cost-effectively. It is further preferred that the spinning rotor has been subjected to a heating process prior to the coating application of the present invention for increasing its hardness.

After the application of several layers, no increase in flaking off of the coating was noted. Instead, when employing a coating in accordance with the present invention, it is possible to avoid any significant reduction of the service life of a coated spinning rotor following the breaking or flaking off of pieces of the coating with embedded hard material granules, and the efficiency of the spinning process can be improved in this manner.

Further details, features and advantages of the present invention are described and will be understood from the following disclosure of a preferred embodiment of the invention with reference to the accompanying drawing figures.

DETAILED DESCRIPTION OF THE PREFERRED EMBODIMENTS

Figure 1:
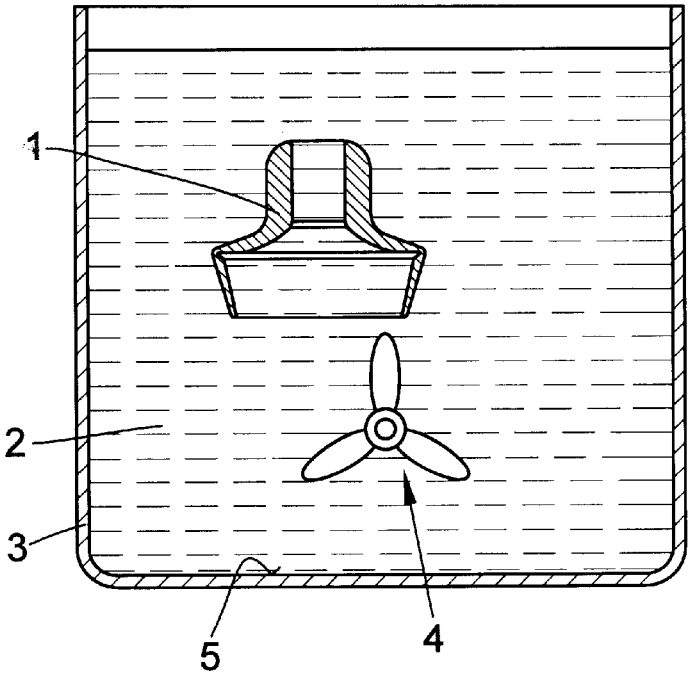
FIG. 1 is a simplified schematic representation of a nickel dispersion bath with a spinning rotor.

The application of the coating in accordance with the present invention to a spinning rotor 1 made of steel takes place in a manner known per se in a single nickel dispersion bath 2 contained in a vat 3, as shown in a simplified schematic representation in FIG. 1. Such a nickel dispersion bath 2, in which the concentration of the hard material granules distributed therein can be preprogrammed, is known from the German Patent Publication DE 197 13 159 A1, for example. During the coating process in the nickel dispersion bath 2, the spinning rotor 1 is disposed with the axis of rotation of the spinning rotor 1 oriented vertically, as indicated in FIG.

First, the outside of the spinning rotor 1 is coated in the nickel dispersion bath 2, without application of electrical current, by a thin layer 6 of nickel which is free of hard material granules and is of 1 $\mu$m to 2 $\mu$m thickness. After the desired layer thickness of this nickel layer has been achieved, an agitator 4 indicated in the vat 3 is placed into operation. The nickel dispersion bath 2 is stirred by means of the agitator 4, and thereby stirs up hard material granules, in the present case diamond granules, which precipitated to the bottom 5 of the vat 3 while the agitator 4 was stopped. The swirled-up diamond granules are distributed in the nickel dispersion bath 2, and a layer 7 containing such hard material granules, basically consisting of nickel with embedded diamond granules 8, is formed on the initial layer 6, which is free of hard material granules.

To keep the distribution of the diamond granules in the nickel dispersion bath 2 uniform, the nickel dispersion bath 2 is continuously stirred by the agitator 4 during this phase of the coating process and is kept in motion. After a layer thickness of approximately 15 $\mu$m has been achieved, the agitator 4 is deactuated again. The nickel dispersion bath 2 is accordingly no longer stirred, and the diamond granules distributed therein fall to the bottom 5 of the vat 3 under the influence of gravity. As a result, the concentration of the diamond granules distributed in the nickel dispersion bath 2 is reduced to the extent that the spinning rotor 1 is again in a dispersion of almost pure nickel. In this phase of the coating process, wherein the concentration of the diamond granules in the nickel dispersion bath 2 approaches zero or is zero, a further layer 9, essentially free of hard material granules, is applied to the layer 7 containing hard material granules to a thickness of approximately up to 8 $\mu$m.

A second layer 10 containing hard material granules and of a thickness of approximately 10 $\mu$m is thereafter applied on the layer 9, which is free of hard material granules, by means of a renewed activation of the agitator 4 and, then, by means of deactivating the agitator 4 again, a further layer 11 is applied, which is free of hard material granules to a large degree and has a thickness of approximately 2 $\mu$m.

Figure 2:
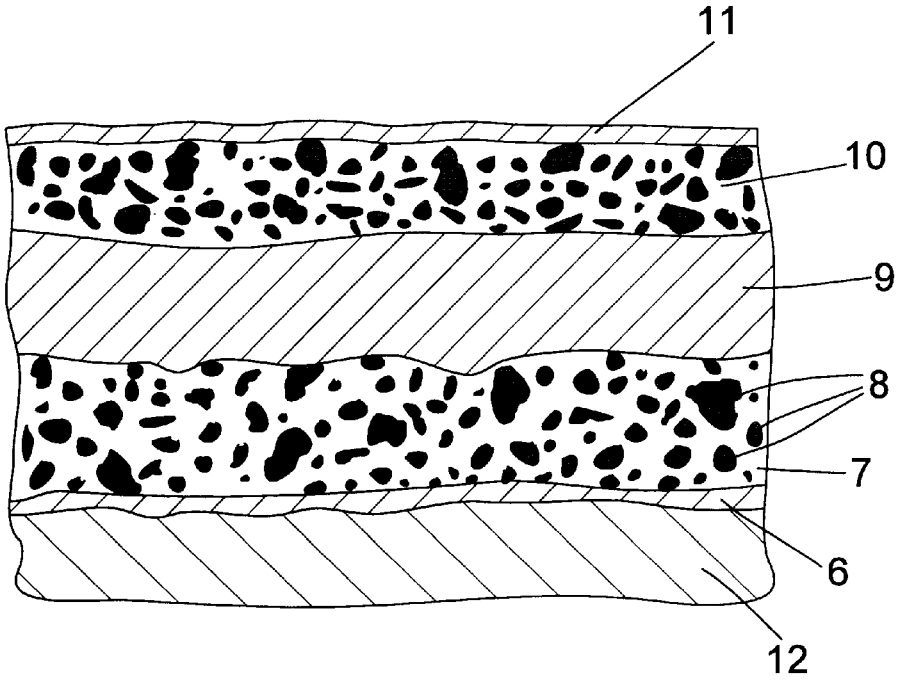
FIG. 2 is an enlarged schematic representation of a coating in accordance with the invention, shown in a sectional view.

The build-up of these layers on the surface of the base body 12 made of steel of the spinning rotor 1 can be seen in FIG. 2.

The layers 7, 10 containing hard material granules, and the layers 6, 9, 11 free of hard material granules, can alternatively be applied sequentially in a manner known per se in two separate baths.

If in the course of a cleaning process, known per se as described above and therefore not described in greater detail herein, a spinning rotor 1, coated in accordance with the invention, is cleaned by means of a scraper, not represented for reasons of simplicity, and if in the course of this the undesired breaking or flaking off of a piece of the wear layer occurs, it has been shown that only the upper layer 10 containing hard material granules is separated partially or over the entire layer thickness down to or down into the area of the layer 9 free of hard material granules. The deeper layer 7 containing hard material granules is preserved and provides wear protection and possibly also the desired roughness in a manner comparable to that which existed prior to the separation.

In contrast to customary spinning rotors, the wear protection and the spinning properties of the spinning rotor in accordance with the invention are preserved following the damage to the surface due to breaking or flaking off of pieces of the layer with embedded hard material granules. Thus, a considerable extension of the service life of the spinning rotor 1 in case of occurring damage, and therefore a clear improvement of the efficiency of the spinning process, is achieved.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention.

The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A spinning rotor for an open-end spinning frame, the rotor having surfaces for contacting textile fibers being spun or a resultantly spun yarn, the surfaces having a coating comprised of at least two layers of a non-ferrous metal with hard material granules embedded therein, and an intermediate layer of a non-ferrous metal essentially free of hard material granules between the layers containing hard material granules.

2. The spinning rotor in accordance with claim 1, characterized in that the nonferrous metal is nickel.

3. The spinning rotor in accordance with claim 2, characterized in that the layers are precipitated from a nickel dispersion bath in which the concentration of the hard material granules distributed therein is predetermined.

4. The spinning rotor in accordance with claim 1, characterized in that the hard material granules are diamond granules.

5. The spinning rotor in accordance with claim 1, characterized in that the layers containing hard material granules are at least about 10 $\mu$m thick.

6. The spinning rotor in accordance with claim 1, characterized in that the intermediate layer essentially free of hard material granules is between about 2 $\mu$m and about 10 $\mu$m thick.

7. The spinning rotor in accordance with claim 1, characterized in that the non-ferrous material is hardenable, and that the spinning rotor has been subjected to a heating process for increasing hardness.

* * * * *